United States Patent [19]

Weiler et al.

[11] 4,060,911

[45] Dec. 6, 1977

[54] PROCESS FOR THE PREPARATION OF A CONTAINER CLOSED UNDER STERILE CONDITIONS AND CONTAINING LYOPHILIZED MATERIAL

[75] Inventors: Herbert Weiler, Marburg, Marbach; Hans Schneider; Wolfgang Von Janecek, both of Marburg an der Lahn; Ludwin Weyrich, Buchenau, all of Germany

[73] Assignee: Behringwerke Aktiengesellschaft, Marburg an der Lahn, Germany

[21] Appl. No.: 602,911

[22] Filed: Aug. 7, 1975 (Under 37 CFR 1.47)

[51] Int. Cl.[2] ..... B65B 31/04; B67B 3/22; B67B 3/24; F26B 5/06

[52] U.S. Cl. ..... 34/5; 21/2; 34/15; 53/101

[58] Field of Search ..... 21/2; 34/5, 15; 53/101, 53/102

[56] References Cited

U.S. PATENT DOCUMENTS

| | | | |
|---|---|---|---|
| 2,465,706 | 3/1949 | Bauman | 53/101 |
| 3,022,619 | 2/1962 | Strong et al. | 53/264 |
| 3,199,216 | 8/1965 | Broadwin | 34/5 |
| 3,286,366 | 11/1966 | Seligman | 34/5 |
| 3,293,772 | 12/1966 | Gottfried et al. | 53/102 |
| 3,587,899 | 6/1971 | Bender et al. | 215/307 |
| 3,708,886 | 1/1973 | Ogle | 34/5 |
| 3,795,986 | 3/1974 | Sutherland et al. | 34/5 |

FOREIGN PATENT DOCUMENTS 7,426,691 11/1974 Germany.

*Primary Examiner*—Morris O. Wolk
*Assistant Examiner*—Bradley Garris
*Attorney, Agent, or Firm*—Curtis, Morris & Safford

[57] ABSTRACT

A process for the preparation of a container closed under sterile conditions and containing lyophilized material, which comprises 1. filling the material to be lyophilized into a container,
2. putting a rubber stopper and a closing cap loosely on the container,
3. introducing the container with its contents into a lyophilization apparatus,
4. lyophilizing the contents,
5. within the lyophilization apparatus and in a single operation, pressing the rubber stopper deep into the container, at the same time pressing the closing cap onto the same, and
6. removing the container closed under sterile conditions from the lyophilization apparatus.

1 Claim, 2 Drawing Figures

PROCESS FOR THE PREPARATION OF A CONTAINER CLOSED UNDER STERILE CONDITIONS AND CONTAINING LYOPHILIZED MATERIAL

The present invention provides a process for the preparation of a container closed under sterile conditions and containing lyophilized material.

In general, pharmaceutical compositions or reagents which are to be lyophilized, are filled into containers, for example bottles, in the form of aqueous solutions. Then, rubber stoppers of a special form are inserted to half of their length into the containers. The containers thus prepared are then placed into the lyophilization apparatus. After lyophilization, the rubber stoppers are pressed hydraulically in the chamber into the containers. The containers are then taken out of the apparatus and are transported to a flanging machine which places an aluminum cap onto them under sterile conditions and edges it up or down. This latter process step is very time-consuming. Moreover, the space between the rubber stopper and the flange cap cannot be kept sterile, or only with great difficulty. When the solutions are taken out for injections, bacteria and fungi which are present between the rubber stopper and the flange cap can be brought right down into the bottle by way of the injection syringe, thus infecting the injection solution. In the organism of a patient they can therefore cause conditions that are dangerous to life.

The present invention provides a process for the preparation of a container closed under sterile conditions with lyophilized material, which comprises 1. filling the material to be lyophilized into a container,
2. putting a rubber stopper and a closing cap loosely on the container,
3. introducing the container with its contents into a lyophilization apparatus,
4. lyophilizing the contents,
5. within the lyophilization apparatus and in a single operation, pressing the rubber stopper deep into the container, at the same time pressing the closing cap onto the same, and
6. removing the container closed under sterile conditions from the lyophilization apparatus.

As closing cap, use is suitably made of the plastic cap of the Utility Model of the German Federal Republic No. G 74 26 691, which consists of two parts being connected by at least three, preferably from four to 10, bridging members, the upper part of which comprising a plate, optionally provided with an adjoining ring, and the lower part comprising a ring whose inner wall has a circumferential groove, said ring receding conically to the outside at the side opposite the bridging elements.

This plastic cap is mainly suitable for the packaging of reactants. By a slightly twisting movement of the plastic cap, the bridging elements are cut, the upper part can be taken off, and the rubber stopper can be removed.

Figure 1:
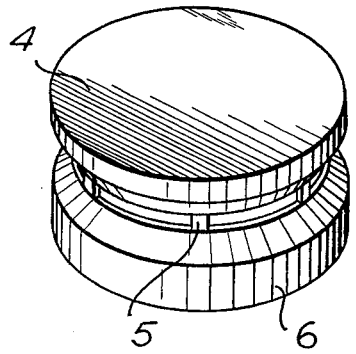
Figure 2:
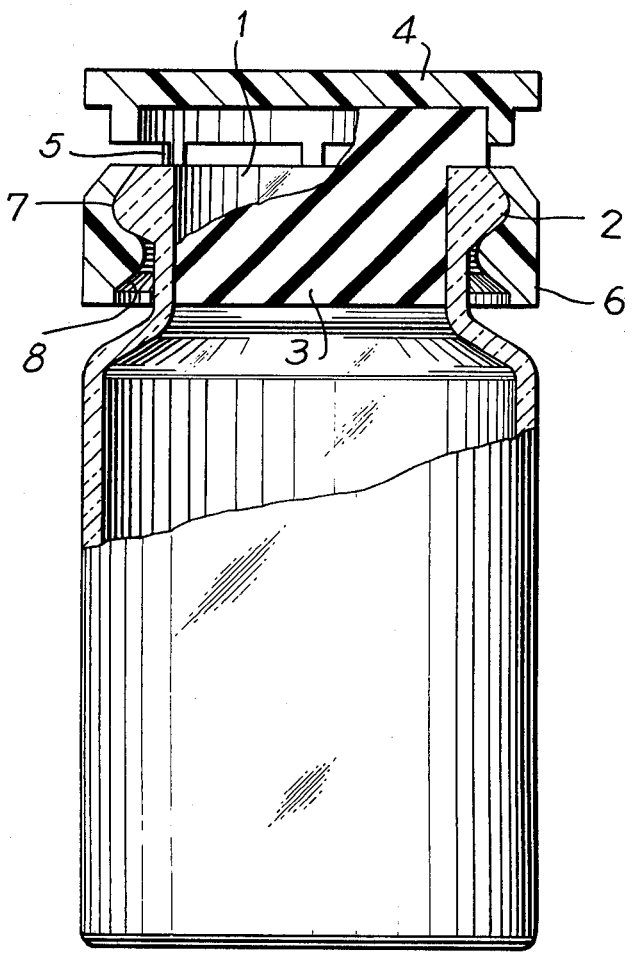

A better understanding of the present invention can be had by referring to the accompanying drawing, in which FIG. 1 is a perspective view of a closing cap as described above and FIG. 2 is a front view, partially in section, of a container sealed with such a closing cap.

The Figures show a container having opening 1 for filling an emptying, said container having bead 2 around the outer rim of said opening. The opening is sealed by rubber stopper 4, over which is a closing cap comprising upper plate part 4 joined by a plurality of bridging members 5 to lower ring portion 6 which has circumferential groove 7 in its inner wall, said groove 7 cooperating in sealing relationship with bead 2 on the container.

For injection preparations, the plate of the upper part of the closing cap may be provided with a pull-off flap which can be torn off. The rubber stopper is thus made accessible for the needle of the injection syringe, and the contents of the bottle can be dissolved and taken out under sterile conditions. If the pull-off flap is provided, the bridging elements between the top and the bottom parts of the plastic cap are not required. The process of the invention to prepare a container closed under sterile conditions for lyophilized material is effected as follows:

After the containers have been filled with the solution to be lyophilized, the rubber stoppers are inserted and the closing caps are placed over these rubber stoppers by the same machine. The solutions are then lyophilized in the usual manner. After the lyophilization process has been completed, the rubber stoppers are pressed into the containers, and the closing caps are at the same time pressed onto the containers with the lyophilized solution. In this manner, the transportation of the containers to the flanging machine, as well as the placing and flanging of the aluminum caps are no longer necessary.

During the pressing process in the lyophilization apparatus, the groove of the bottom part of the closing cap catches into the roll of the edge of the container. The rubber stopper is thus originally secured. Accordingly, the closing cap represents an original closure. If the closing cap is removed, the bridging elements will tear off. The lower ring remains at the container, whereas the upper part cannot be used any more. If the pull-off flap is removed, an opening in the form of the flap remains in the plate of the upper part of the plastic cap, and the damaging is detected without difficulty.

A special advantage of the process of the invention is to be seen in the fact that a subsequent infection with germs, which may occur during transportation and flanging, is excluded. The withdrawal of the lyophilized material, too, is facilitated by means of the new closing cap. For example, in the case of reagents where the rubber stopper is likewise to be removed, the removal of the aluminum flange cap is difficult and may cause injuries. In contradistinction thereto, the plate of the closing cap can be easily lifted with a slight pressure of the thumb. For preparations to be used as injection preparations, the closing cap provided with a pull-off flap may be used, which flap can be torn off easily and without any risk of an injury.

We claim:

1. In a process for preparing and packaging a lyophilized material by the steps of filling a container with the material to be lyophilized, loosely closing said container with a rubber stopper, introducing the loosely-stoppered container with the material in the container into a lyophilization apparatus, which apparatus is maintained under sterile conditions, lyophilizing the material in the container, pressing the rubber stopper into the container while the container is in the lyophilization apparatus, whereby said container is sealed, and then removing the sealed container from the lyophilization apparatus, the improvements wherein (1) said container has an external circumferential bead thereon, (2) a snap-on closure cap having an internal circumferential groove sealably engageable with said bead on said container is also loosely placed on said container over said rubber stopper before the loosely-stoppered container is introduced into said lyophilization apparatus, and (3) said closure cap is simultaneously pressed into snap-on sealing engagement with said container, over said rubber stopper, as said rubber stopper is pressed into the container, whereby said container is provided, under sterile conditions, with a snap-on closure cap over said rubber stopper.

* * * * *